US005566849A

United States Patent [19]

Goehner

[11] Patent Number: 5,566,849

[45] Date of Patent: Oct. 22, 1996

[54] HINGE STRUCTURE FOR A BOX

[75] Inventor: Steven J. Goehner, Hartland, Wis.

[73] Assignee: Goehner Industries, Inc., Dousman, Wis.

[21] Appl. No.: 322,995

[22] Filed: Oct. 14, 1994

Related U.S. Application Data

[63] Continuation-in-part of Ser. No. 262,685, Jun. 20, 1994, abandoned.

[51] Int. Cl.[6] ..... B65D 6/12

[52] U.S. Cl. ..... 220/7; 220/4.33; 220/6

[58] Field of Search ..... 220/6, 7, 4.34, 220/4.33, 685

[56] References Cited

U.S. PATENT DOCUMENTS

| | | | |
|---|---|---|---|
| 2,775,361 | 12/1956 | Kasdan | 220/4.34 |
| 3,266,656 | 8/1966 | Kridle | 220/4.33 |
| 3,315,639 | 4/1967 | Close | 220/4.33 |
| 3,940,007 | 2/1976 | Griffiths | 220/4.33 |
| 4,828,132 | 5/1989 | Francis, Jr. et al. | 220/4.33 |
| 5,377,857 | 1/1995 | Taravella et al. | 220/7 |

FOREIGN PATENT DOCUMENTS

| | | | |
|---|---|---|---|
| 94/01333 | 1/1994 | WIPO | 220/4.33 |

*Primary Examiner*—Joseph M. Moy
*Attorney, Agent, or Firm*—Jansson & Shupe, Ltd.

[57] ABSTRACT

The disclosure relates to boxes and containers for stowing boxes. An aspect of the disclosure involves a hinge structure having a pair of flexibly-connected channels, each of which has a pair of substantially parallel side panels extending from a rib. An edge of a box wall member is received in at least one of the channels. The side panels extend substantially the same distance from the rib so that the side panels simultaneously engage the edge upon edge insertion. When the hinge structure is used as device to affix the top cover to a box, the "coextensive" channel side panels make it easy to fit the top cover to the box walls. Also disclosed are a box bottom member having new features, a new container, a new family of containers for stowing boxes and a new hinge structure for attaching segments of a split wall member.

10 Claims, 10 Drawing Sheets

FIG. 6
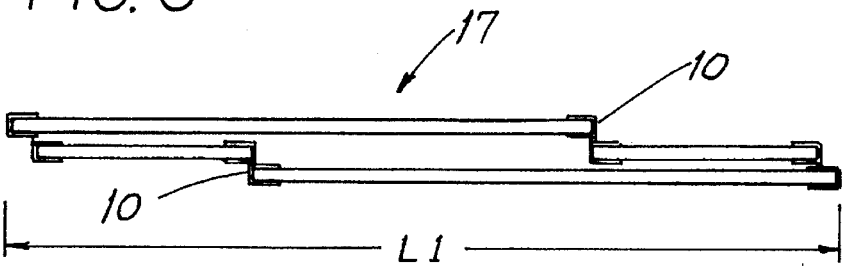
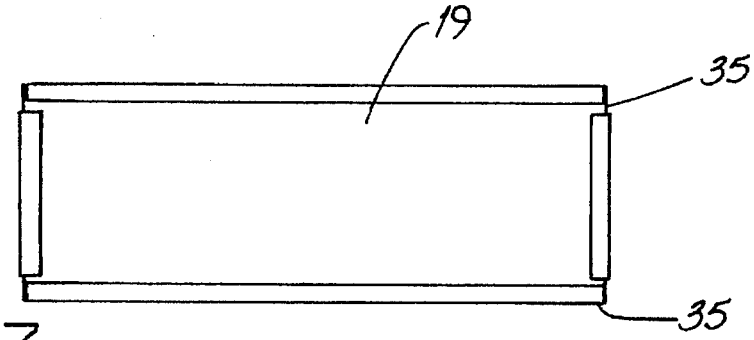
FIG. 7
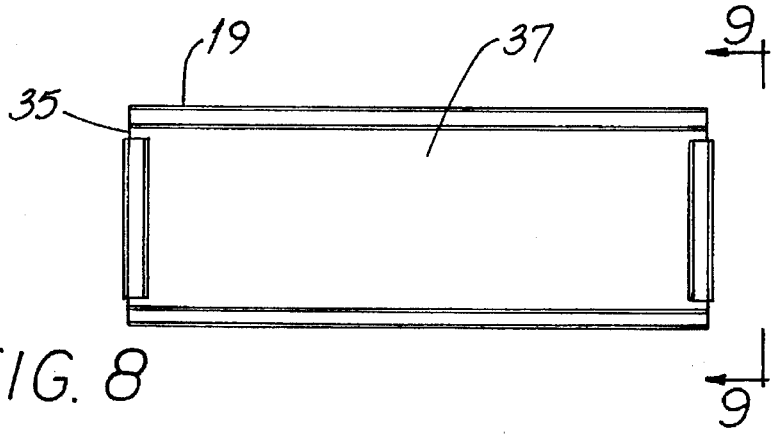
FIG. 8
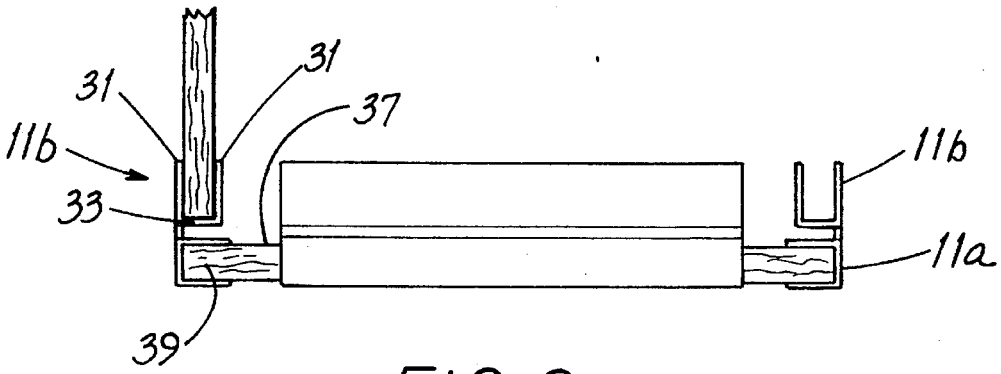
FIG. 9

FIG. 13
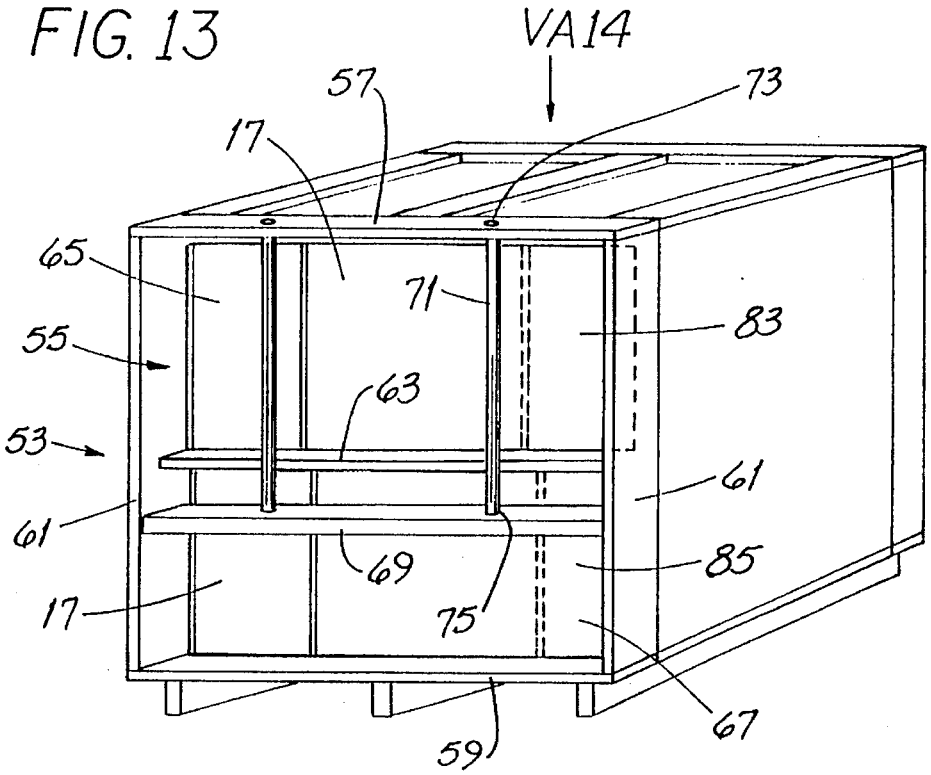
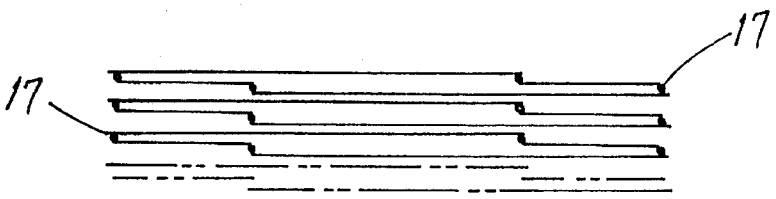
FIG. 14
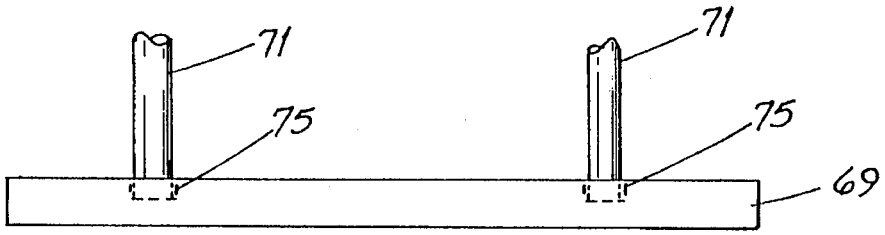
FIG. 15

HINGE STRUCTURE FOR A BOX

RELATED APPLICATION

This Application is a continuation-in-part of application Ser. No. 08/262,685 filed on Jun. 20, 1994, and now abandoned.

FIELD OF THE INVENTION

This invention relates to special receptacles and, more particularly, to rigid-walled receptacles of the folding type.

BACKGROUND OF THE INVENTION

Packaging and shipment of certain commercial and industrial goods often requires that such goods be packed in a box or box-like receptacle which is "custom-made" for the product. Often, such receptacles are made of corrugated cardboard. But some goods require that the receptacle be more. "robust" to withstand rough handling and/or simply because the goods themselves are quite heavy for their size.

In instances where the receptacle usage rate is high, the sheer number and bulk of receptacles "on site" at the shipping facility can present storage and handling problems. At least for that reason, special receptacles are often designed so that for storage, they can be stored folded, partly-disassembled or both. The amount of floor space thus saved is very significant. Such receptacles are set up just prior to placement of goods within the receptacle.

For boxes and other receptacles which may be stored folded and/or partly disassembled, an important consideration is the ease with which the various box components can be assembled just prior to packing and shipment. Of course, a box requiring little time to assemble adds very little to the total manufactured cost of the goods. On the other hand, a box which is difficult and time-consuming to assemble will add materially to such cost. And such a box will be a source of frustration and aggravation to those charged with the set-up task.

To cite a more specific example, one type of known wood box, made of plywood and lumber, found use in packing and shipping electrical products. Such box has a removable top and bottom and four side walls. Each pair of walls is attached together at the wall adjacent edges by a strip-like dual-channel type of hinge structure made of polyvinylchloride (PVC).

The channels face at 90° degrees to one another and are attached to one another by a thin flexible web-like piece, also made of PVC but of a different formula for flexibility. When all four box walls are attached together by four lengths of hinge structure, one at each of the four box corners, the walls are folded flat "parallelogram fashion" for storage and shipping and in the course of box assembly are unfolded to define a rectangle.

A component of the finished box includes a pallet-like bottom portion. Such portion uses "1×4" floor-contacting stringers, plural "shoes" atop the stringers and sawn lumber atop the shoes to form the bottom of the box. For larger boxes, the shoes are "3×4" lumber and three shoes are required to support the sawn lumber fastened atop such shoes and forming the actual box "floor."

Components of such known wood box are shipped using an enlarged version of the box itself and from which the top and front are removable. Corner channels are aluminum and at least some shipping boxes have two compartments. As a general matter, these shipping boxes do not hold up well and often need repair or outright replacement.

A problem with the aforementioned wood box relates to the "interconnection" of the box top cover to the four side walls. The hinge structure is also used for that purpose. Each of the four edges of such top cover has attached thereto a length of hinge structure. Specifically, one channel of each such structure fits tongue-and-groove fashion along an edge of the top cover. All of such edge-attached channels face inward generally toward one another.

The other channel of each length of hinge structure faces downward and each such channel is intended to engage the top edge of one of the walls, also in tongue-and-groove fashion. However, the inward side panel of those channels engaging wall top edges (i.e., that side panel which is inside the box when the top cover is being placed or is in place) is shorter than the outward side panel.

As a consequence, the inward side panel of each length of channel almost invariably "catches on" the top edge of the wall to which that channel is to be attached. And such inward side panel, being on the inside of the box as the cover is being placed, cannot be reached to force it to fit over the wall edge. The problem has persisted for a few years and engendered a number of attempts to solve it. Such efforts include reducing the thickness of the plywood from which the walls are made, using a better (and more expensive) grade of plywood and replacing (on the top cover) the PVC hinge structure with aluminum edge fasteners. Such efforts themselves spawned yet other problems, not the least of which is that the manufactured cost of the box was significantly increased and approached the selling price.

Still another problem arising from the aforementioned wood box and hinge structure is that when the channels are relatively moved (as they are when the four walls are folded flat for storage) the web-like piece often tore or became at least partly separated from one of the channels. The integrity of a box corner, formed by the hinge structure, is therefore impaired—the box splits or tends or tends to split at a corner.

Another problem arising from the aforementioned hinge structure is that the channel side panels sometimes break along a line parallel to the structure long axis. Such side panels are simply not sufficiently strong to withstand the rigors of the application.

Yet another problem relates to the construction and resulting cost of the bottom portion as used in bottom portions for larger boxes, "3×4" shoes are relatively expensive. And the sawn lumber forming the box floor has relatively low bending resistance. Consequently, three such "3×4" shoes, one intermediate the ends of the bottom portion, are required to adequately support such sawn lumber.

Still another problem relating to the aforementioned wood box is that when folded for shipment, the box is inordinately long and is approximately equal to the length of a box side added to the horizontal dimension of a box end. As a result, the containers in which such folded boxes are shipped are relatively large.

An improved hinge structure and related box and box container which addresses the above-noted problems would be an important advance in the art.

OBJECTS OF THE INVENTION

It is an object of the invention to provide an improved hinge structure and related box and box container overcoming some of the problems and shortcomings of the prior art.

Another object of the invention is to provide an improved hinge structure and related box and box container which are very easy to use.

Another object of the invention is to provide an improved hinge structure and related box in which the integrity of the hinge structure is maintained during folding and unfolding.

Yet another object of the invention is to provide an improved hinge structure and related box wherein the box top cover is quick and easy to install.

Another object of the invention is to provide an improved hinge structure and related box having a reduced manufactured cost.

Still another object of the invention is to provide an improved hinge structure which has improved resistance to breakage.

Another object of the invention is to provide an improved box container which is very durable and withstands the rigors of repeated shipping and use.

Another object of the invention is to provide an improved container which securely retains box components during shipment and yet makes such components available for easy dispensing from the container.

Yet another object of the invention is to provide a hinge structure for use in a box end and which materially shortens the length of a folded box. How these and other objects are accomplished will become apparent from the following descriptions and from the drawing.

SUMMARY OF THE INVENTION

An aspect of the invention relates to a hinge structure having a pair of flexibly-connected channels. Such structure is used to attach flat sheets of plywood together to make a four-sided box and is also used to attach the top cover to the box. In this specification, such hinge structure is sometimes referred to as a "corner-bend" hinge since in the resulting box, hinge bending is at the corners of the erected box.

More specifically, four lengths of such structure are used to connect four rectangular plywood wall members together to form a wall assembly. When so used, each channel receives the inserted edge of a wall member therebetween.

Each channel has a pair of substantially parallel side panels extending from a rib and in the improvement, the side panels extend substantially the same distance from the rib.

The side panels engage the edge substantially simultaneously upon edge insertion. That is, there is substantially no opportunity for one of the side panels to "catch" on the edge and prevent good channel/edge engagement.

In another aspect of the hinge structure, the side panels of each channel have a thickness and the channels are connected by a strand of flexible material extending between the channels. Such strand has a dimension between the channels and in a highly preferred embodiment, the dimension of the strand is at least 1.5 times the thickness of a channel side panel.

In one specific embodiment, the strand dimension is about 0.125 inches and the side panel thickness is about 0.060 inches, i.e., the length of the strand is about two times the thickness of a channel side panel. Such strand is much more resistant to tearing when the hinge structure is folded and unfolded.

When making a box, the hinge structure is combined with components of a box. Such components include plural wall members for forming the upright sides of the box and a box bottom member. Such bottom member includes a plurality of "stringers" (wood strips on which the box rests) and a box floor portion spaced and supported above the stringers by a plurality of spacer-like "shoes." Preferably, the floor portion is made of a composite wood product such as parallel strand lumber (PSL). Such wood product exhibits bending resistance far superior to that of similarly-dimensioned pieces of sawn lumber.

The box bottom member has a pair of ends with a shoe at each end. Such shoes define an open region therebetween which is free of floor portion support, i.e., which is free of shoes. It has been discovered that "two-shoe" bottom members (as opposed to three-shoe or four-shoe members) are very satisfactory, even for larger boxes, when used with a floor portion made of PSL. Further, the shoes may be made of "2×4" lumber rather than more costly "3×4" lumber.

Yet other aspects of the invention relate to the hinge structure combined with a box top member, another component of the box. Such top member, also made of a rectangular plywood sheet, has four perimeter edges and a surface which is inside the box when the box is fully assembled. The channels of a hinge structure comprise what may be termed a first channel and a second channel.

An edge of the top member plywood sheet is inserted into the first channel and when so assembled, the rib of the second channel is substantially parallel to the top member interior surface. The side panels of the second channel extend about the same distance from such interior surface. Thus, when the downwardly-depending second channels of the top member are fitted to engage the top edges of the box walls, the side panels of such second channel engage such top edges substantially simultaneously upon edge insertion. There is little opportunity for the top member to "hang up" and resist box assembly. And when the top member is properly assembled to the wall assembly, the side panels of the second channel overlap the top edge of the wall member by about the same distance.

Another aspect of the invention involves a container for stowing box components, particularly folded-up wall assemblies. Such container has an interior container cavity bounded by top and bottom edge portions and lateral side portions. A shelf-like partition divides the cavity into a first, upper compartment and a second, lower compartment. A retention rail extends across the second compartment and at least one retainer bar extends between the top edge portion and the retention rail.

Most preferably, there are plural retainer bars extending between the edge portion and the retention rail and each retainer bar is spaced from the other retainer bar and from both side portions. In appearance, the container is not unlike that of a cage. The folded wall assemblies lodged in the first compartment are retained therein during shipping and until ready for use.

More specifically, the top edge portion has a pair of spaced holes through it, each for receiving a separate retainer bar. Each retainer bar is constrained from moving with respect to the hole through which it extends. The retention rail has a pair of pockets formed therein and each pocket is spaced vertically below a hole in the top edge portion. Each pocket receives and supports the end of a separate retainer bar, thereby constraining a retainer bar from moving downward.

However, when it is desired to gain access to the wall assemblies within the first compartment, each retainer bar may be lifted out for easy access. As mentioned in the following summary of methodology, it is most preferred to remove but one retainer bar.

Yet another aspect of the invention involves a family of containers, each for stowing wall assemblies used in making boxes of differing sizes. Each container stows wall assemblies for making a particular (but, container to container, different) box size. Each container of the family has a width and a height differing from the width and height of every other container in the family. On the other hand, each container of the family has a depth substantially equal to the depth of every other container in the family. And for a certain range of box sizes, each container of the family contains the same number of wall assemblies, e.g., 25 or 50 folded-up wall assemblies.

And the invention has yet other novel aspects. At least one of the containers in the family also stows top members used in making boxes. Such container includes a partition dividing the container into first and second compartments with the top members being stowed in the first compartment and the wall assemblies being stowed in the second compartment. The second compartment preferably has a retention rail there across to prevent the wall assemblies from falling outward when the front of the container is removed for interior access.

And that is not all. Aspects of the invention also include a new hinge structure for attaching two segments of a split wall member to one another. Such new hinge structure is sometimes referred to as a "middle-bend" hinge since in use it permits a split or segmented wall member to be folded. Such middle-bend hinge significantly reduces the length of a folded box.

The new structure has first and second channels, each having a rib generally parallel to the rib of the other channel. The first channel has a pair of spaced channel side panels extending in a first direction while the second channel has a pair of spaced channel side panels extending in a second direction generally 180° opposite the first direction.

A resilient strand extends between and connects the ribs of the first and second channels so that when the channels are engaged with separate segments of a split wall member, e.g., the split "halves" or segments of a box end, such wall member can be folded inward upon itself when storing the box. The resulting length of the folded box is about equal to the length of one of the longer sides of the box.

More specifically, the first and second channels of the middle-bend hinge each have an outward corner juxtaposed in close proximity to the outward corner of the other channel. The strand extends between the outward corners.

The middle-bend hinge structure is used with components of a box including four wall members for forming the upright sides of a box. At least one of the wall members is split into first and second segments with the first channel being attached to the first segment and the second channel being attached to the second segment so that such segments may be folded with respect to one another.

Still another aspect of the invention involves a method for dispensing a group of products, e.g., box wall assemblies. Each of such products has a lateral edge and is stored in a compartment of a container. The compartment has a front opening and a pair of retainer bars extending across the front opening. The method includes the steps of withdrawing one of the retainer bars to provide a free space, grasping the lateral edge of a product and withdrawing the product through the free space.

More specifically, the container has first and second compartments stowing first and second groups of products, respectively. Each product of both groups has a top edge and the compartments are separated by a partition. The new method also includes the steps of withdrawing all of the products comprising the first group of products and positioning the partition to expose the second group of products. A top edge of a product of the second group is grasped and such grasped product is lifted out of the container. In a more specific method, the positioning step includes removing the partition from the container.

Other details of the invention are set forth in the following detailed description and in the drawing.

BRIEF DESCRIPTION OF THE DRAWING

FIG. 6 is a top plan view of the wall assembly of FIG. 5 folded for stowing and shipment.

FIG. 7 is a top plan view of a top member used as a cover-like closure with the wall assembly of FIG. 5.

FIG. 8 is a bottom plan view of the top member of FIG. 7.

FIG. 9 is an edge view of the top member of FIGS. 7 and 8 taken along the viewing plane 9—9 of FIG. 8.

FIG. 13 is a perspective elevation view of a container shown with the container front removed and with wall assemblies stored inside.

FIG. 14 is a simplified top plan view of several wall assemblies folded for storage and as such wall assemblies would appear when viewed along viewing axis VA14 of FIG. 13 and with the container top removed.

FIG. 15 is a view of the retention rail and retainer bars of the container of FIG. 13. Parts are broken away and surfaces of parts are shown in dashed outline.

DETAILED DESCRIPTION OF PREFERRED EMBODIMENTS

In the following specification, details of the new hinge structure are set forth first. There follows a description of several components for making a box or similar enclosure. Such components include a folding wall assembly and also include a bottom member and a top member.

Those descriptions are followed by descriptions of special containers used to stow and ship certain components and by a description of a family of containers used for boxes of differing sizes. Finally, a method for dispensing products, e.g., box wall assemblies, from a container is set forth.

The "Corner-Bend" Hinge Structure and Wall Assemblies Made Therefrom

Figure 1:
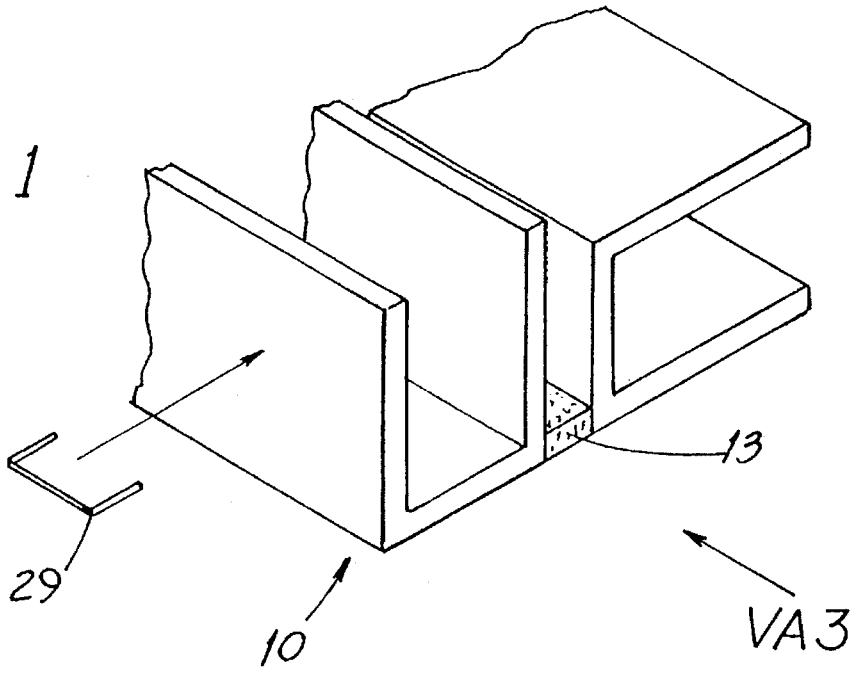
FIG. 1 is a perspective view of what is arbitrarily referred to as a type "A" "corner-bend" hinge structure. Parts are broken away.
Figure 2:
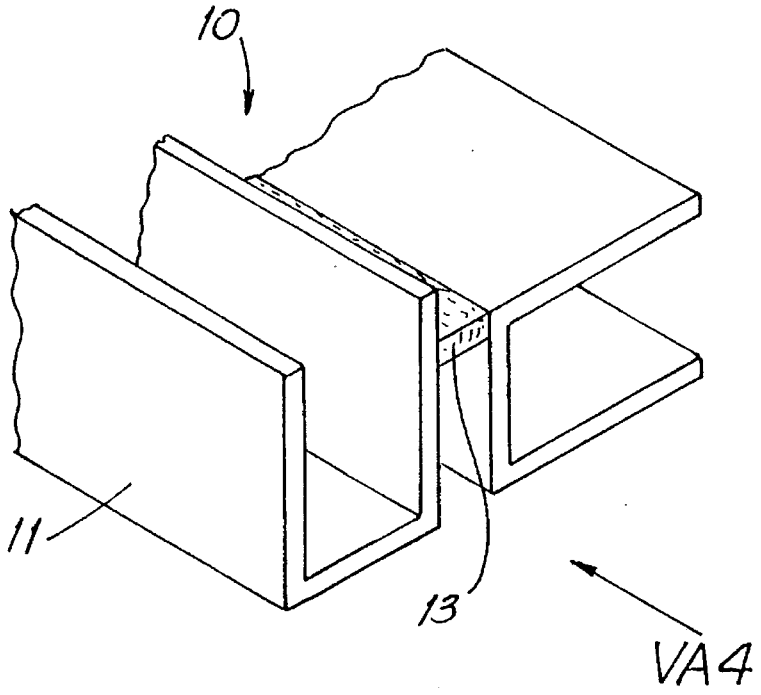
FIG. 2 is a perspective view of what is arbitrarily referred to as a type "B" "corner-bend" hinge structure. Parts are broken away.
Figure 3:
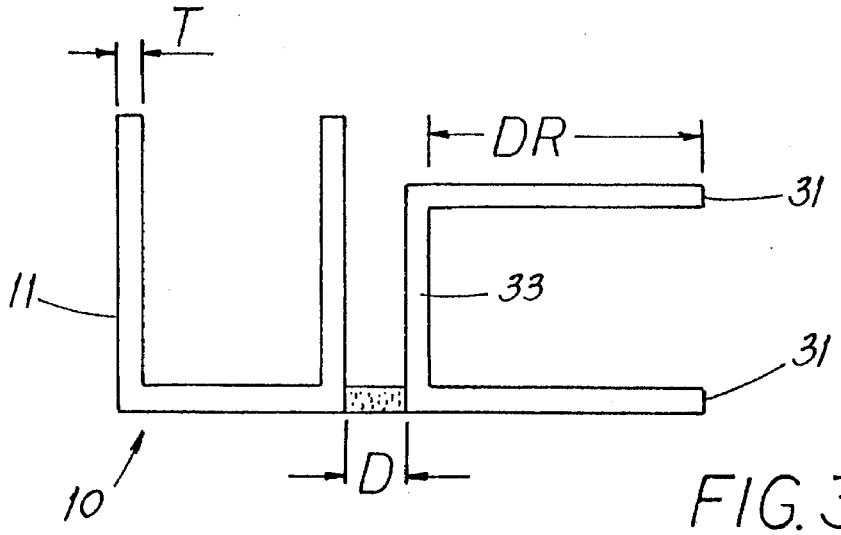
FIG. 3 is an end view of the hinge structure of FIG. 1 taken along the viewing axis VA3 thereof.
Figure 4:
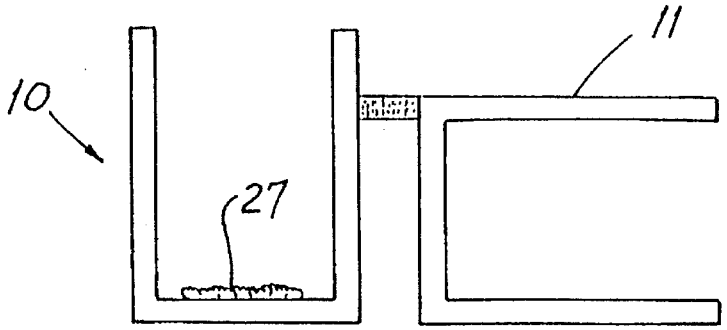
FIG. 4 is an end view of the hinge structure of FIG. 2 taken along the viewing axis VA4 thereof.

Referring to FIGS. 1–4, the corner-bend hinge structure 10 is configured in an "A" type, shown in FIGS. 1 and 3 and a "B" type shown in FIGS. 2 and 4, both types being arbitrary designations. Such types are often referred to as "left" and "right" because of the way they are used in making a wall assembly.

Figure 21:
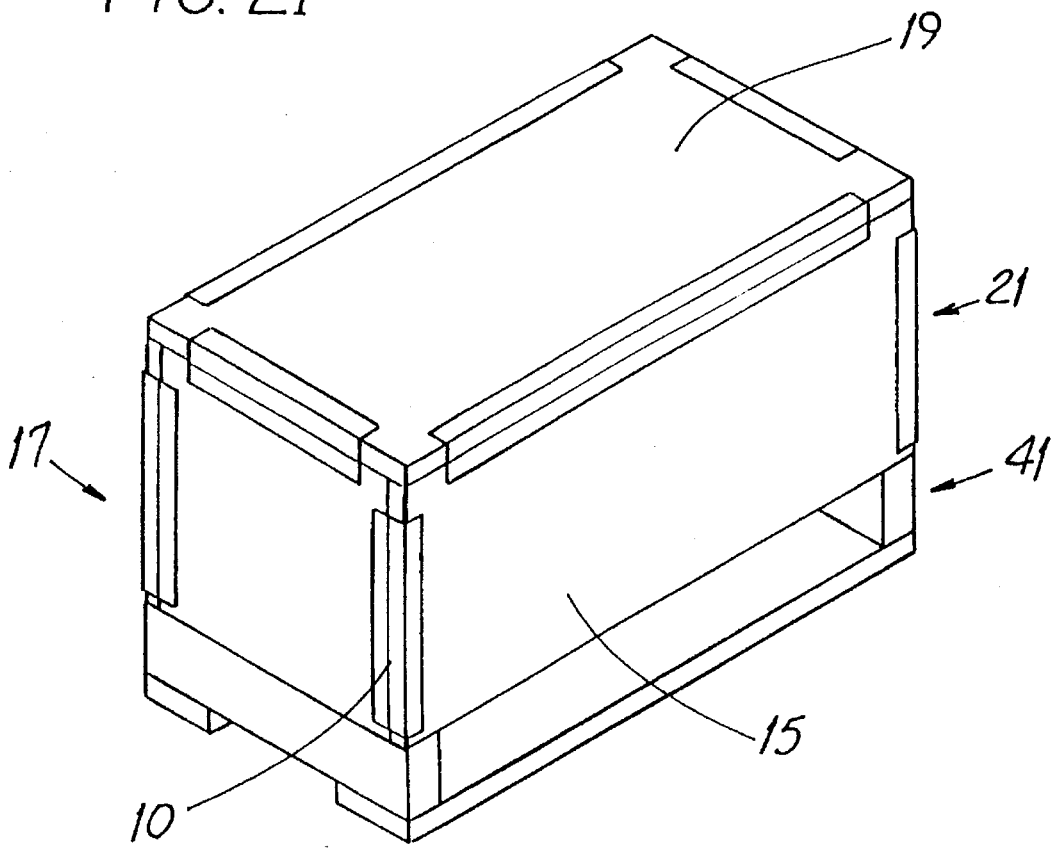
FIG. 21 is a perspective view of a box.
Figure 22:
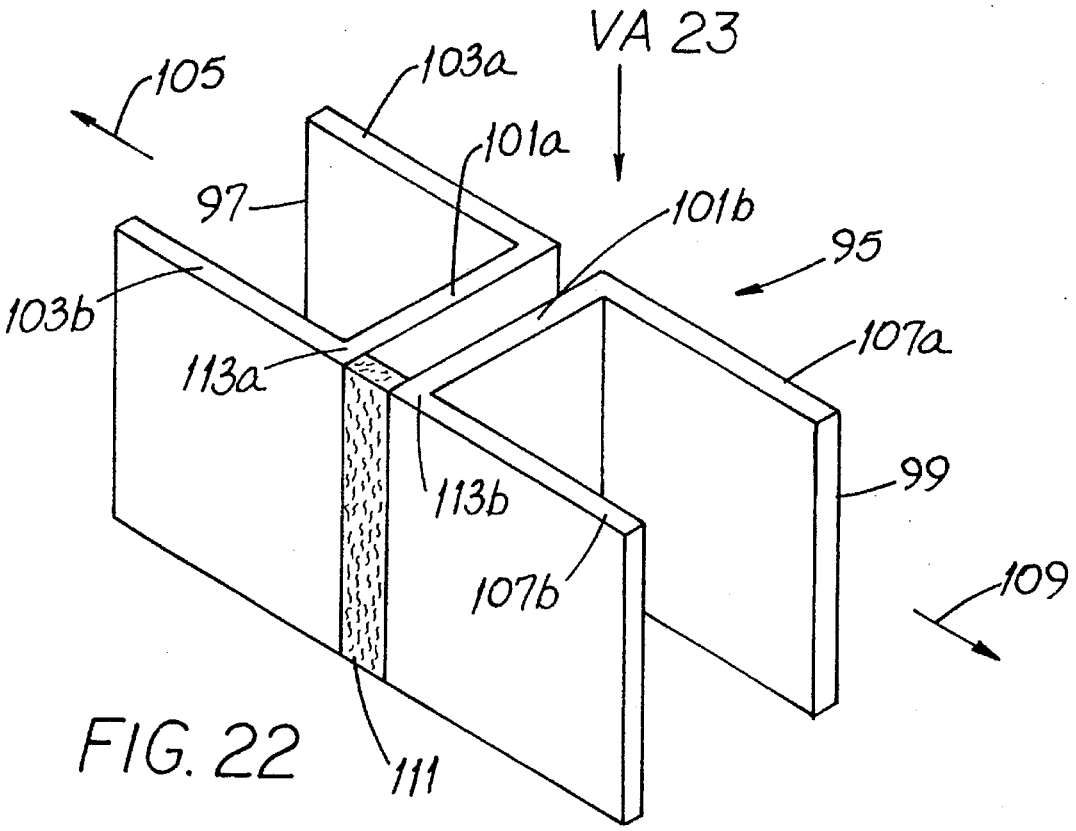
FIG. 22 is a perspective view of a "middle-bend" hinge structure.
Figure 23:
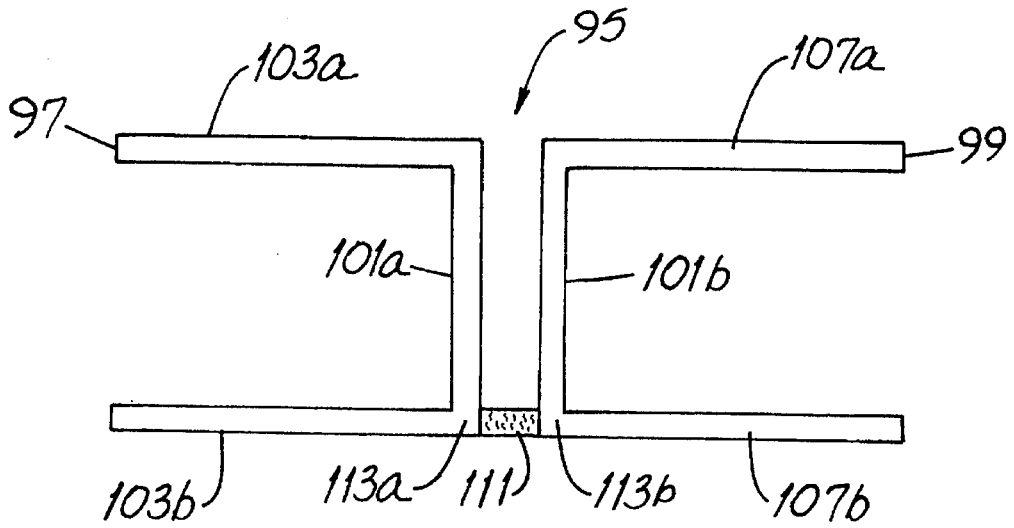
FIG. 23 is a top plan view of the hinge structure of FIG. 22 taken generally along the viewing axis VA23 of FIG. 22.

The structure 10 has a pair of U-shaped channels 11 flexibly connected together by a resilient strand 13. The channels 11 and the strand 13 are both made of PVC but of differing formulas, one rigid and the other flexible. Such structure 10 is used to attach flat wall members 15 together to make a four-sided wall assembly 17 as shown in the erected position in FIG. 5 and in the folded position in FIG. 6. The structure 10 is also used to attach the top cover 19 to the box 21 shown in FIG. 21 and described below.

More specifically, four lengths 23 of such structure 10 are used to connect four rectangular wall members 15 together to form a wall assembly 17. Preferred wall members 15 are plywood but other sheet materials can certainly be used. When so used, each channel 11 receives the inserted edge 25 of a wall member 17 therebetween. A "line" of glue 27 is placed in a channel 11 prior to edge insertion and, preferably, a few staples 29 are placed along each channel 11 to hold the edge 25 and channel 11 together until the glue 27 fully sets up.

Each channel 11 has a pair of substantially parallel side panels 31 extending from a rib 33. In the improved hinge structure 10, the side panels 31 extend substantially the same distance "DR" from the rib 33. Considering FIG. 5 (and also considering the description below of how a top member is fitted to a wall assembly), one may now readily see how the side panels 31 engage the edge 25 substantially simultaneously upon edge insertion. That is, there is substantially no opportunity for one of the side panels 31 to "catch" on the edge 25 and prevent good channel/edge engagement.

In another aspect of the hinge structure 10, the side panels 31 of each channel 11 have a thickness "T" and the strand 13 has a dimension "D" between the channels 11. In a highly preferred embodiment, the dimension "D" of the strand 13 is at least 1.5 times the thickness "T" of a channel side panel 31. In one specific embodiment, the strand dimension "D" is about 0.125 inches and the side panel thickness "T" is about 0.060 inches, i.e., the length of the strand 13 is about two times the thickness of a channel side panel 31. The strand 13 of substantially increased (2×) dimension is much more resistant to tearing when the hinge structure 10 is folded and unfolded. And the 20% increase in side panel thickness makes such side panels 31 much more resistant to cracking and splitting.

The hinge structure 10 is also used to make other box components, i.e., a box top cover 19. Referring to FIGS. 7–9, such top cover 19, also made of a rectangular plywood sheet, has four perimeter edges 35 and a surface 37 which is inside the box 21 when the box 21 is fully assembled. Attached to each edge 35 is one channel 11 of a length of type "A" hinge structure 10 shown in FIGS. 1 and 3. Referring particularly to FIG. 9, in describing the top cover 19 the channels 11 comprise what may be termed a first channel 11*a* and a second channel 11*b*.

An edge 39 of the top cover 19 is inserted into the first channel 11*a* and when so assembled, the rib 33 of the second channel 11*b* is substantially parallel to the top member interior surface 37. The side panels 31 of the second channel 11*b* extend about the same distance from such interior surface 37.

Figure 5:
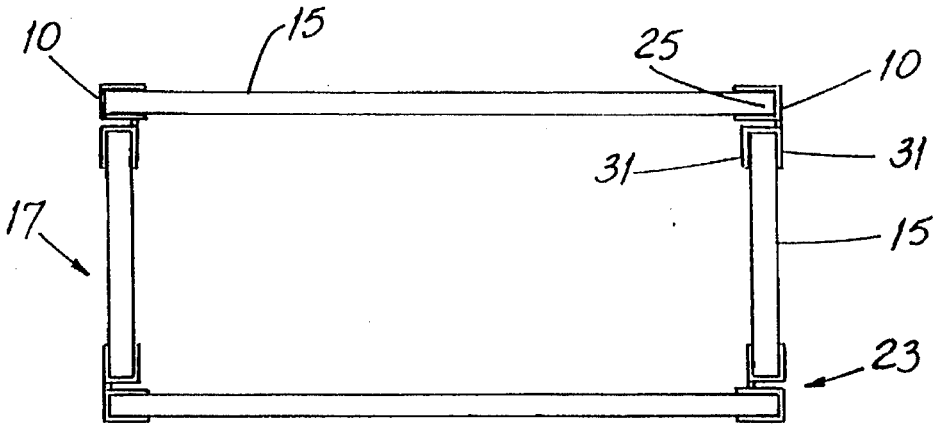
FIG. 5 is a top plan view of a wall assembly unfolded for making a box or similar enclosure. Each corner of the wall assembly has a length of type "A" or type "B" hinge structure therealong.

Thus, when the downwardly-depending second channels 11*b* of the top cover 19 are fitted to engage the top edges 25 of the box wall members 15 shown in FIG. 5, the side panels 31 of the second channel 11*b* engage such top edges 25 substantially simultaneously upon edge insertion, i.e., as the top cover 19 is pressed down. There is little opportunity for the interior side panel 31 to "hang up" on an edge 25 of a box wall member 15 and resist box assembly. And when the top cover 19 is properly assembled to the wall assembly 17, the side panels 31 of the second channel 11*b* overlap the top edge 25 of the wall member 25 by about the same distance as also shown in FIG. 9.

Figure 10:
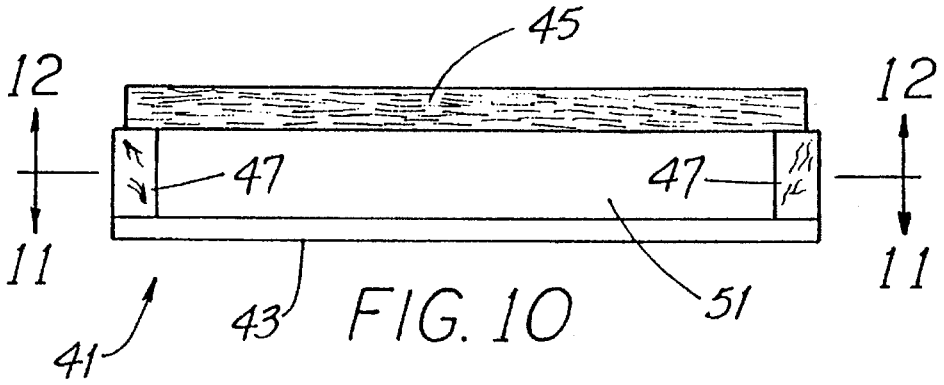
FIG. 10 is a side elevation view of the bottom member component of a box.
Figure 11:
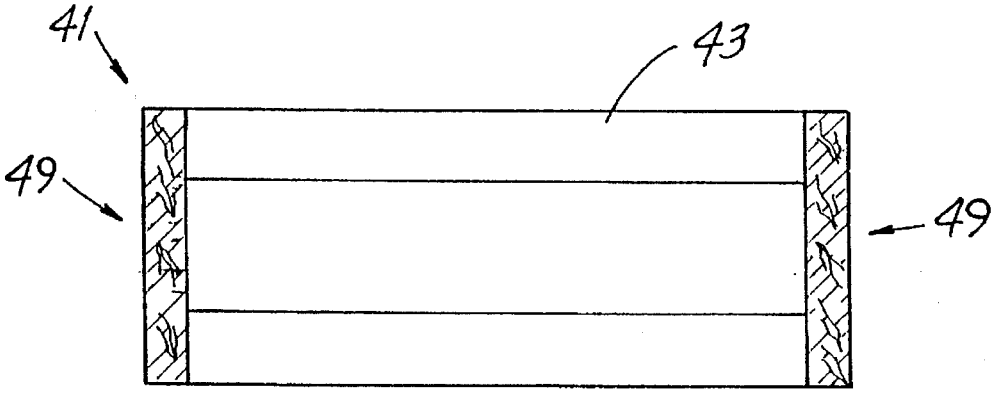
FIG. 11 is a "down-looking" plan view taken generally along the viewing plane 11—11 of FIG. 10.
Figure 12:
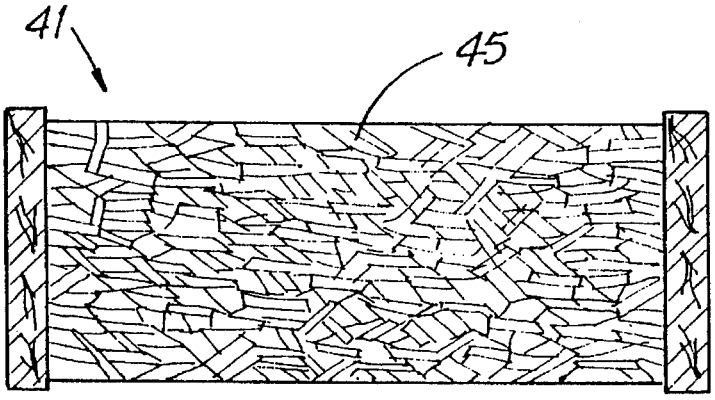
FIG. 12 is an "up-looking" plan view taken generally along the viewing plane 11—11 of FIG. 10.

Referring now to FIGS. 10–12, the box bottom member 41 will now be described. Such bottom member 41 includes a plurality of "stringers" 43 (sawn lumber strips on which the finally-assembled box rests) and a box floor portion 45 spaced and supported above the stringers 43 by a plurality of spacer-like shoes 47. Preferably, the floor portion 45 is made of a composite wood product such as parallel strand lumber (PSL). Such wood product exhibits bending resistance far superior to that of similarly-dimensioned pieces of sawn lumber.

A shoe 47 is at each end 49 of the bottom member 41 but, significantly, not between the ends 49. The shoes 43 define an open region 51 between them which is free of floor portion support, i.e., which is free of shoes 47. The depicted bottom member 41 is very satisfactory, even for larger boxes 21 containing very heavy goods. Highly preferred shoes 47 are made of "2×4" lumber rather than heavier and more costly "3×4" lumber.

The Container

Referring now to FIG. 13, the new container 53 will now be described. Such container 53 stows box components, particularly folded-up wall assemblies 17. And a variant container 53, described below, also stows box top covers 19 as well as wall assemblies 17.

Such container 53 (which is shown with its front closure removed) has an interior cavity 55 bounded by top and bottom edge portions 57,59, respectively, and lateral side portions 61. A shelf-like partition 63 divides the cavity 55 into a first, upper compartment 65 and a second, lower compartment 67. A retention rail 69 extends across the second compartment 67 and at least one retainer bar 71 extends between the top edge portion 57 and the retention rail 69. As will be appreciated after considering the description below, the retention rail 69 and the retainer bars 71 help hold wall assemblies 17 in place in the container 53 while such assemblies 17 are being removed one-by-one therefrom.

Most preferably, there are plural retainer bars 71 each extending between a separate hole 73 in the edge portion 57 and the retention rail 69. Each retainer bar 71 is spaced from the other retainer bar 71 and from both side portions 61. ,And the retention rail 69 is positioned between the partition 63 and the bottom edge portion 59. In appearance, the container 53 is not unlike that of a cage.

Considering FIG. 14 also, folded wall assemblies 17 are lodged on edge in the first compartment 65 and in the second compartment 67. If the top of the container 53 were to be removed and a viewer looks down into the first compartment 65 along viewing axis VA 14, the wall assemblies 17 appear generally as shown in FIG. 14. Such assemblies 17 are retained therein during shipping and until ready for use.

Referring also to FIG. 15, the retention rail 69 has a pair of cylindrical pockets 75 formed in it. Each pocket 75 is spaced vertically below a corresponding hole 73 in the top edge portion 57. Each pocket 75 receives and supports the end of a separate retainer bar 71, thereby constraining a retainer bar 71 from moving downward. However, when it is desired to gain access to the wall assemblies 17 within the first compartment 65, each retainer bar 71 may be lifted out for easy access. As pointed out in the following description of the methodology, it is most preferred to remove but one retainer bar 71.

Figure 16:
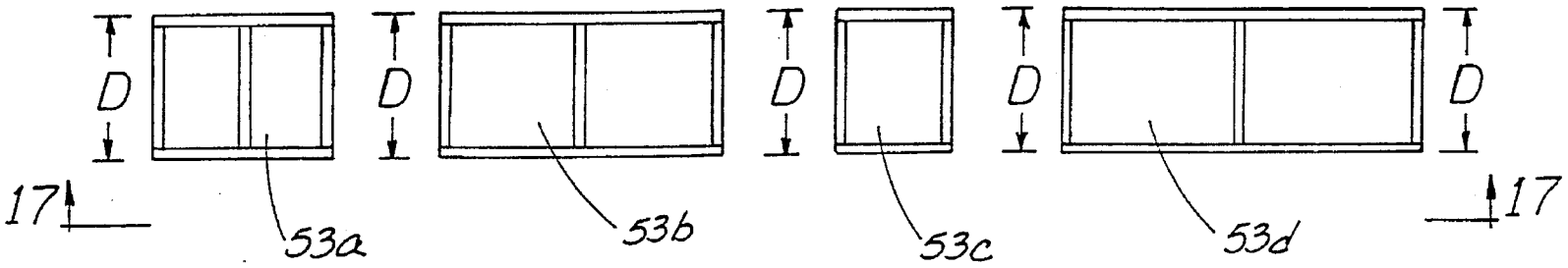
FIG. 16 is a top plan view of an exemplary family of containers, each for holding wall assemblies of a different size.
Figure 17:
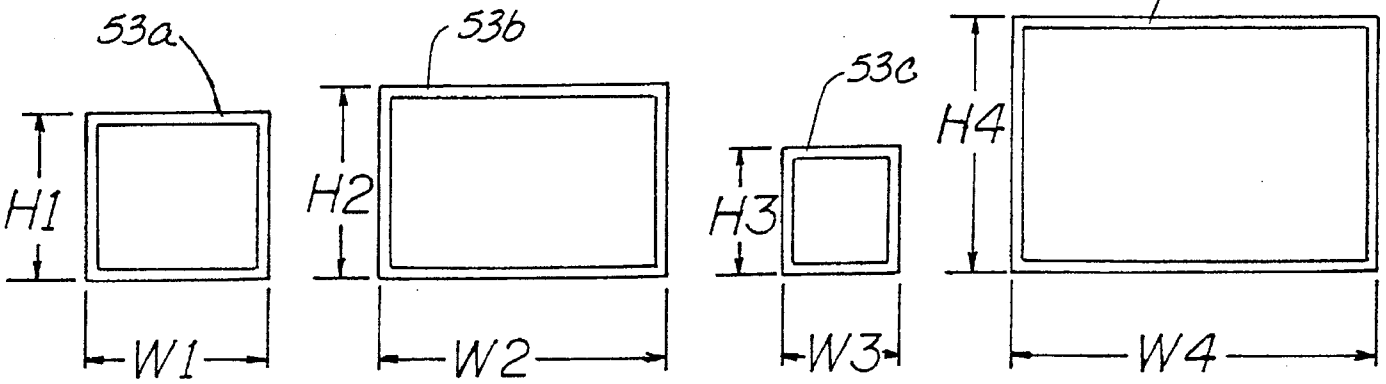
FIG. 17 is a front elevation view of the containers of FIG. 16 taken along the viewing plane 17—17 thereof.

Referring now to FIGS. 16 and 17, yet another aspect of the invention involves a family of containers 53 comprising exemplary containers 53*a*, 53*b*, 53*c* and 53*d*. Each container 53 is used for stowing wall assemblies 17 used in making boxes 21 of differing sizes. That is, each container stows 53 wall assemblies 17 for a single box size but container to container, wall assemblies 17 for each of several other box sizes are stowed.

Each container 53 of the family has a width "W" and a height "H" differing from the width and height of every other container 53 in the family. On the other hand, each container 53 of the family has a depth "D" substantially equal to the depth of every other container 53 in the family. And for a certain range of box sizes, each container 53 of the family contains the same number of wall assemblies 17, e.g., 25 or 50 folded-up wall assemblies 17 standing on edge as shown in FIG. 14. The container 53 shown in FIG. 13 stows 50 folded-up wall assemblies 17, 25 each in the upper compartment 65 and in the lower compartment 67.

Figure 18:
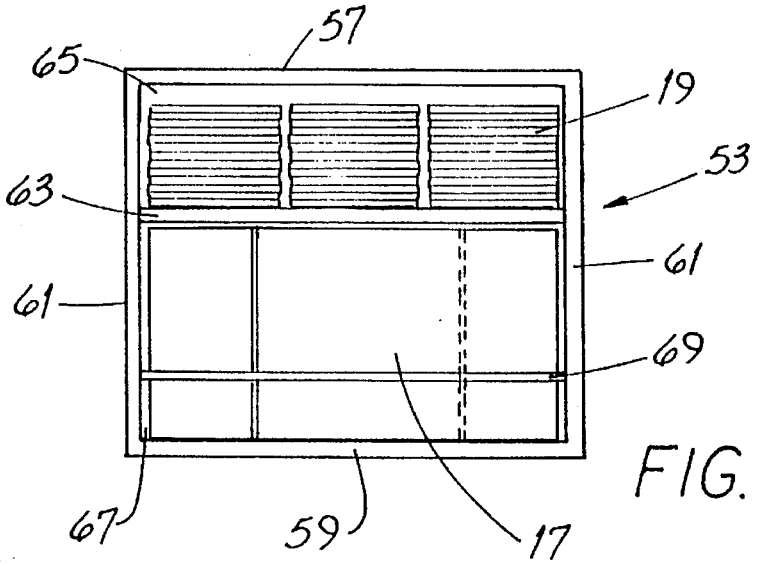
FIG. 18 is a front elevation view of a container used for stowing taller wall assemblies and box top members. The container front is removed.

And that is not all. As shown in FIG. 18, at least one of the containers 53 in the family also stows top covers 19 used in making boxes 21. Such container 53 includes a partition 63 dividing the container into first and second compartments 65, 67, respectively, with the top covers 19 being stowed in the first compartment 65 and the wall assemblies 17 being stowed in the second compartment 67. The second compartment 67 preferably has a retention rail 69 across it to prevent the wall assemblies 17 from falling or tipping outward when the front of the container is removed for interior access. The container 53 of FIG. 18 is preferred when the wall assemblies 17 to be stowed are quite tall and it is not practical (from either a container or wall assembly handling standpoint) to have two "tiers" of such assemblies 17. The container 53 of FIG. 18 holds an exemplary 25 folded-up wall assemblies 17.

Method For Dispensing Wall Assemblies

Figure 19:
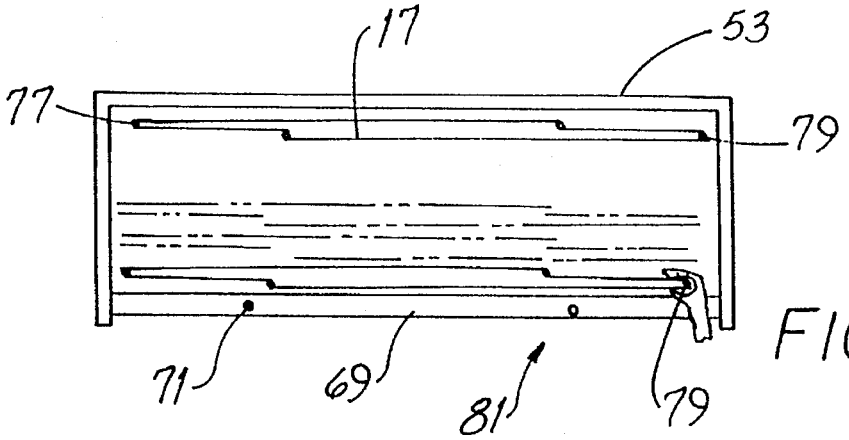
FIG. 19 is a top plan view showing how wall assemblies are ready to be dispensed from the container of FIG. 13 when one retainer bar is removed.
Figure 20:
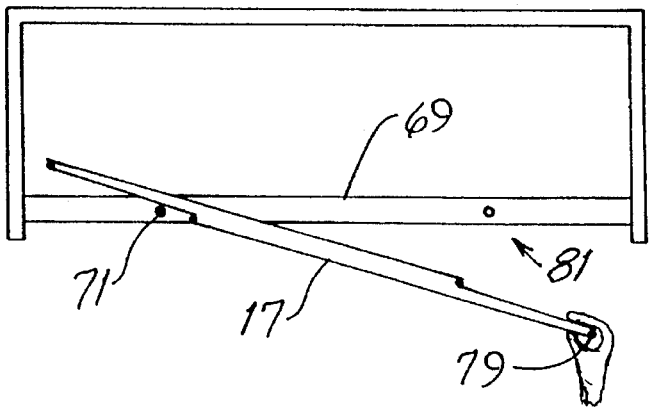
FIG. 20 is a top plan view showing how a wall assembly is drawn angularly out of the container of FIG. 13.

Still another aspect of the invention involves a method for dispensing a group of products, e.g., box wall assemblies 17, from a container 53 such as that shown in FIG. 13. Referring also to FIGS. 19 and 20, each of such assemblies 17 has a lateral edge 77, 79 and is stored in a compartment 65 as particularly shown in FIG. 19. When it is desired to remove the wall assemblies 17 for box setup preparatory to packing goods therein, one of the retainer bars 71, e.g., the righthand bar 71, is withdrawn upward through the hole 73 in the top edge portion 57 to provide a free space 81. The setup person grasps the lateral edge 79 of a wall assembly 17 and as illustrated in FIG. 20, angularly withdraws the product through the free space 81.

This arrangement has a very significant advantage. That retainer bar 71 left in its hole 73 and pocket 75, e.g., the lefthand retainer bar 71 as shown in FIGS. 19 and 20, help prevent wall assemblies 17 from falling forward out of the compartment 65. Of course, the setup person must also exercise reasonable care and, it is submitted, such assemblies 17 fall forward only when the setup person either intends that result or is grossly negligent.

More specifically, first and second groups of products 83, 85, respectively are stowed in the first and second compartments 65, 67, respectively. Each product of both groups 83, 85 has a top edge 25 and the compartments 65, 67 are separated by a partition 63. The new method also includes the steps of withdrawing all of the products comprising the first group 83 of products and positioning the partition 63 to expose the second group 85 of products. A top edge 25 of a product of the second group 85 is grasped and such grasped product is lifted across the retention rail 69 and out of the container 53. And like the bars 71, the rail 69 helps prevent wall assemblies 17 in the lower compartment 67 from falling forward. In a more specific method, the positioning step includes removing the partition 63 from the container 53.

From the foregoing, it will be appreciated how the new corner-bend hinge structure 10 with its strand 13 of increased dimension and its "beefed-up" side panels 31 helps make a sturdier box 21. And the fact that such side panels 31 are of equal length and shorten the time needed to affix a top cover 19 to an erected wall member 17 should not be overlooked. Further, the use of a composite wood product in the bottom member 41 effects a very significant cost reduction. The importance of cost reduction is forcefully illustrated by the fact that most persons exercise conscious cost-related decisions when making any significant purchase.

The"Middle-Bend" Hinge Structure And Wall Assemblies Made Therefrom

And there is yet another aspect of the disclosure which provides yet additional advantages. Referring next to FIGS. 22, 23, 24 and 25, in the box 21 of FIGS. 24 and 25, the wall member 15 is split into two segments 93*a*, 93*b*. A middle-bend hinge structure 95 is configured to attach such segments 93*a*, 93*b* to one another and has first and second channels 97 and 99, respectively. (The structure 95 is referred to as a "middle-bend" hinge structure 95 since it permits a box wall member 15 to be folded in the middle.)

Figure 24:
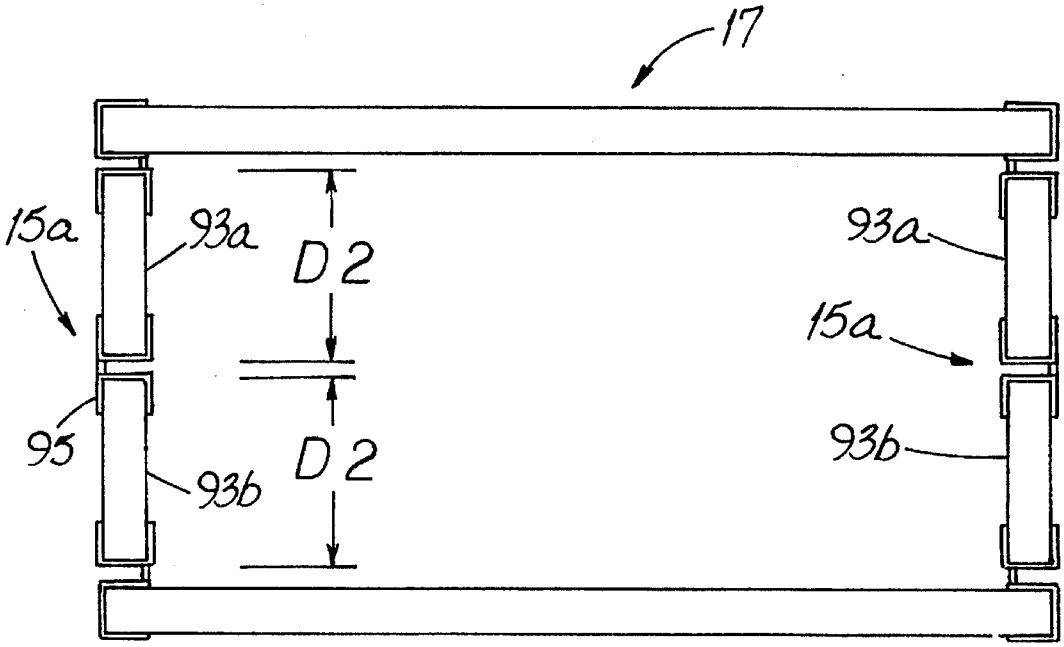
FIG. 24 is a top plan view of an erected wall assembly made using the hinge structure of FIGS. 22 and 23.

Each channel 97, 99 has a rib 101 which is generally parallel to the rib 101 of the other channel 99, 97 when the segments 93*a*, 93*b* are oriented as shown in FIG. 24, i.e., when the box 21 is erected ready for use. The first channel 97 has a pair of spaced channel side panels 103*a*, 103*b* extending in a first direction (as indicated by the arrow 105) while the second channel 99 has a pair of spaced channel side panels 107*a*, 107*b* extending in a second direction (as indicated by the arrow 109) generally opposite the first direction. A resilient strand 111 extends between and connects the ribs 101*a*, 101*b* of the channels 97 and 99.

More specifically, each of the channels 97, 99 has an outward corner 113 and 113*b*, respectively. (Such corners are said to be "outward" since they are at the exterior of the box 21 when such box 21 is erected for use as shown in FIG. 24.) The outward corners 113*a*, 113*b* are juxtaposed in close proximity with one another and the strand 111 extends between them. And the outward side panels 103*a*, 103*b* of the channels 97, 99, respectively, are coplanar with one another as are the inward side panels 103*a*, 107*b* of such channels 97, 99.

Figure 25:
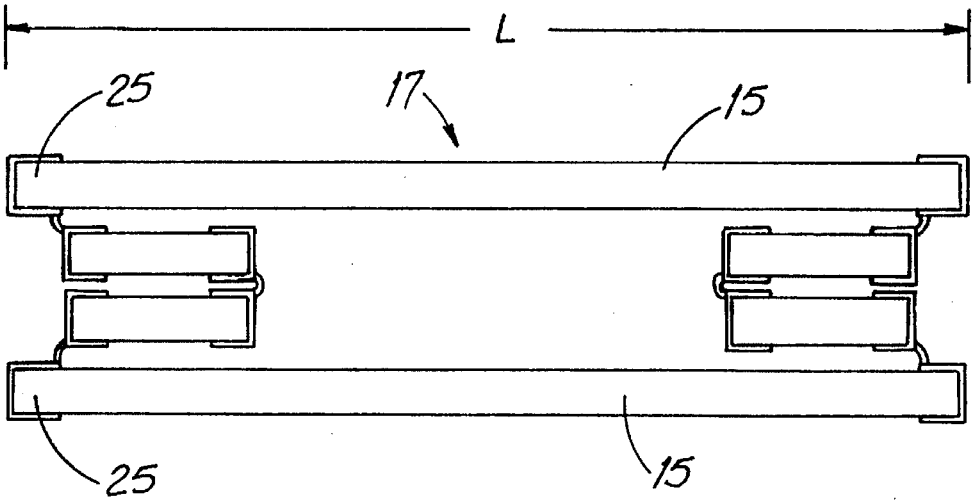
FIG. 25 is a top plan view of a folded wall assembly made using the hinge structure of FIGS. 22 and 23.

From the foregoing, it will be apparent that when a folded box 21 is equipped with a middle-bend hinge structure 95 and when the folded wall assembly 17 (as shown in FIG. 25) is dispensed from the container 53, the person handling the wall assembly 17 grasps adjacent edges 25 of two parallel opposed wall members 15 rather than the edges 25 of two adjacent wall members 15 as shown in FIG. 20.

When the structure 95 is combined with components of a box 21, e.g., with four wall members 15, it is preferred that each of the opposed wall members 15*a* be split into first and second segments 93*a*, 93*b* and that such segments 93*a*, 93*b* have the same dimension "D2." So configured, the folded wall assembly 17 has a length "L" (measured left-to-right in FIGS. 24 or 25) which is substantially equal to the length of the longer wall member 15 if the box 21 is not square. This is in contrast with the wall assemblies 17 shown in FIGS. 6, 19 and 20 which have a length "L1" substantially equal to the total length of the longer and the shorter wall members 15. Therefore, the width "W" of a container 53 can be significantly less when containing wall assemblies 17*a* made using the hinge structure 95.

As used in this specification, the term "box" 21 is intended to denote an enclosure generally without regard to whether such enclosure is used to pack and ship products, house pets or is for some other use. And it is also to be understood clearly that while only a few embodiments of the invention have been shown and described, such embodiments are by way of example and are not limiting.

For instance, the number of wall assemblies 17 in a particular container 53 (50 or 25 wall assemblies are mentioned above) is likely to be a function of the size of the finished box 21 made from such wall assemblies 17. Clearly, boxes 21 measuring, say, 2 feet in each dimension present weight and handling considerations which are quite different from those considerations involving boxes 21 measuring, say, 10 feet in each dimension. And in the embodiments described above, ⅜ inch plywood is a preferred stock from which to make wall members 15 and top covers 19. However, other wood or non-wood stocks may also be used.

What is claimed:

1. In a hinge structure having first and second flexibly-connected channels, the first channel receiving the inserted edge of a cover therebetween and the second channel receiving the inserted edge of a wall member therebetween and wherein each channel has a pair of substantially parallel side panels extending from a rib, the improvement wherein:

the channels are flexibly connected by a resilient strand permanently attached to each channel;

the channels are spaced from one another when the cover and wall member are perpendicular to one another;

the side panels of the second channel extend substantially the same distance from the rib of such second channel, whereby the side panels of the second channel engage the edge of the wall member substantially simultaneously upon wall member edge insertion.

2. The structure of claim 1 wherein:

the side panels of each channel have a thickness;

the strand has a dimension between the channels; and the dimension of the strand is at least 1.5 times the thickness of a channel side panel.

3. The structure of claim 2 wherein the length of the strand is about 0.125 inches and such length is about two times the thickness of a channel side panel, whereby such strand is made more resistant to tearing.

4. The hinge structure of claim 1 in combination with components of a box including (a) plural wall members for forming the upright sides of the box, and (b) a box bottom member, and wherein:

the bottom member includes a plurality of stringers and a floor portion spaced from the stringers by a plurality of shoes; and the floor portion is made of a composite wood product, whereby such floor portion has improved resistance against bending.

5. The combination of claim 4 wherein:

the bottom member has a pair of ends;

a shoe is at each end; and the shoes define an open region therebetween which is free of floor portion support.

6. The combination of claim 5 wherein the composite wood product is parallel strand lumber.

7. The hinge structure of claim 1 wherein the cover has an interior surface, and:

the rib of the second channel is spaced from and substantially parallel to the interior surface; and the side panels of the second channel extend about the same distance from the interior surface.

8. A hinge structure for attaching two segments of a split wall member to one another and including:

first and second channels, each channel having a rib generally parallel to the rib of the other channel when the segments are coplanar;

the first channel has a pair of spaced channel side panels terminated at the rib of the first channel and extending in a first direction;

the second channel has a pair of spaced channel side panels terminated at the rib of the second channel and extending in a second direction generally opposite the first direction; and a resilient strand extends between, is bonded to and permanently connects the ribs of the first and second channels, thereby permitting the segments to be folded substantially against one another.

9. The hinge structure of claim 8 wherein:

the first and second channels each have an outward corner;

the outward corners are juxtaposed in close proximity one to another; and the strand extends between the outward corners.

10. The hinge structure of claim 8 in combination with components of a box including four wall members for forming the upright sides of a box having first and second corners and wherein:

at least one of the wall members is split into first and second segments;

the first channel is attached to the first segment;

the second channel is attached to the second segment;

the split wall member extends between the first and second corners; and the channels are positioned between the first and second corners.

* * * * *